US011274378B2

(12) United States Patent
Smith et al.

(10) Patent No.: US 11,274,378 B2
(45) Date of Patent: Mar. 15, 2022

(54) ADAPTIVE APPARATUS FOR RELEASE OF TRAPPED GAS BUBBLES AND ENHANCED AGITATION FOR A PLATING SYSTEM

(71) Applicant: Engineering and Software System Solutions, Inc., San Diego, CA (US)

(72) Inventors: Kelly V. Smith, Tremonton, UT (US); Josh J. Ault, Clinton, UT (US); Jeremy J. Hall, Hooper, UT (US)

(73) Assignee: Engineering and Software System Solutions, Inc., San Diego, CA (US)

( * ) Notice: Subject to any disclaimer, the term of this patent is extended or adjusted under 35 U.S.C. 154(b) by 134 days.

(21) Appl. No.: 16/857,823

(22) Filed: Apr. 24, 2020

(65) Prior Publication Data

US 2021/0230764 A1 Jul. 29, 2021

Related U.S. Application Data

(60) Provisional application No. 62/966,480, filed on Jan. 27, 2020.

(51) Int. Cl.

| | |
|---|---|
| ***C25D 17/08*** | (2006.01) |
| ***C25D 21/10*** | (2006.01) |
| ***C25D 5/04*** | (2006.01) |
| ***C25D 21/04*** | (2006.01) |
| ***C25D 17/02*** | (2006.01) |

(52) U.S. Cl.

CPC ..... *C25D 21/10* (2013.01); *C25D 5/04* (2013.01); *C25D 17/02* (2013.01); *C25D 17/08* (2013.01); *C25D 21/04* (2013.01)

(58) Field of Classification Search

None

See application file for complete search history.

(56) References Cited

U.S. PATENT DOCUMENTS

| | | | | |
|---|---|---|---|---|
| 610,907 | A * | 9/1898 | Langbein | C25D 21/10 204/222 |
| 680,408 | A | 8/1901 | Cowper-Coles | |
| 901,280 | A | 10/1908 | Daniels | |
| 1,315,785 | A | 9/1919 | Lutz | |
| 6,485,627 | B1 | 11/2002 | Johal et al. | |

(Continued)

FOREIGN PATENT DOCUMENTS

| | | | |
|---|---|---|---|
| CN | 108360054 | * 8/2018 | C25D 21/10 |
| CN | 110512269 | * 11/2019 | C25D 21/10 |

(Continued)

*Primary Examiner* — Stefanie S Wittenberg

(74) *Attorney, Agent, or Firm* — Charles F. Reidelbach, Jr.

(57) ABSTRACT

The present disclosure concerns an array of chemical and electrochemical treatment cells. The cells include electrochemical cells that individually include a plating tank, a power supply, and an anode. A flight bar for supporting a cathode is moved from one tank to another for treating and plating a cathode surface. Within an electrochemical tank, the power supply operates a circuit with metal ions being eroded from the anode and being deposited onto the cathode surface. A plating apparatus is configured to simultaneously provide mechanical support, a cathodic connection, and agitation to a cathode in a plating tank. The plating apparatus includes an agitator which rotates the cathode about a fixed pivot connection to provide motion along a lateral axis and a vertical axis.

12 Claims, 4 Drawing Sheets

(56) References Cited

U.S. PATENT DOCUMENTS

| | | | |
|---|---|---|---|
| 7,470,356 | B2 | 12/2008 | You et al. |
| 2013/0161197 | A1 | 6/2013 | Lee |
| 2014/0116884 | A1 | 5/2014 | Kang et al. |
| 2016/0090662 | A1 | 3/2016 | Capulong et al. |

FOREIGN PATENT DOCUMENTS

| | | | | | |
|---|---|---|---|---|---|
| CN | 209636337 | | * | 11/2019 | ..... C25D 11/04 |
| FR | 2887477 | | * | 12/2006 | ..... C25D 7/04 |
| FR | 3070610 | A1 | * | 3/2019 | ..... B65G 49/0454 |
| JP | 63290298 | | * | 11/1988 | ..... C25D 17/08 |
| JP | 01316498 | | * | 12/1989 | ..... H05K 3/241 |
| KR | 101669803 | | * | 10/2016 | ..... C25D 17/06 |
| WO | 2015014292 | A1 | | 2/2015 | |

* cited by examiner

ADAPTIVE APPARATUS FOR RELEASE OF TRAPPED GAS BUBBLES AND ENHANCED AGITATION FOR A PLATING SYSTEM

CROSS-REFERENCE TO RELATED APPLICATIONS

This non-provisional patent application claims priority to U.S. Provisional Application Ser. No. 62/966,480, Entitled "Adaptive Apparatus for Providing Improved Agitation for an Automated Plating System", filed on Jan. 27, 2020, incorporated herein by reference under the benefit of U.S.C. 119(e).

FIELD OF THE INVENTION

The present disclosure relates to an apparatus for enhancing an electroplating system. More particularly, the present disclosure concerns an adaptive apparatus for releasing trapped gas bubbles and providing an enhanced agitation on a production electroplating system applicable to the aerospace industry.

BACKGROUND

Electroplating has many applications. Some applications such as aerospace have precision components that have complicated geometries. One challenge with electroplating are gas bubbles that form on surfaces being plated. Such bubbles result in un-plated defects such as "pits" or voids in a plated surface. When complex and raised features are plated, gas bubbles can be trapped under overhanging surfaces of the features.

SUMMARY

Figure 1:
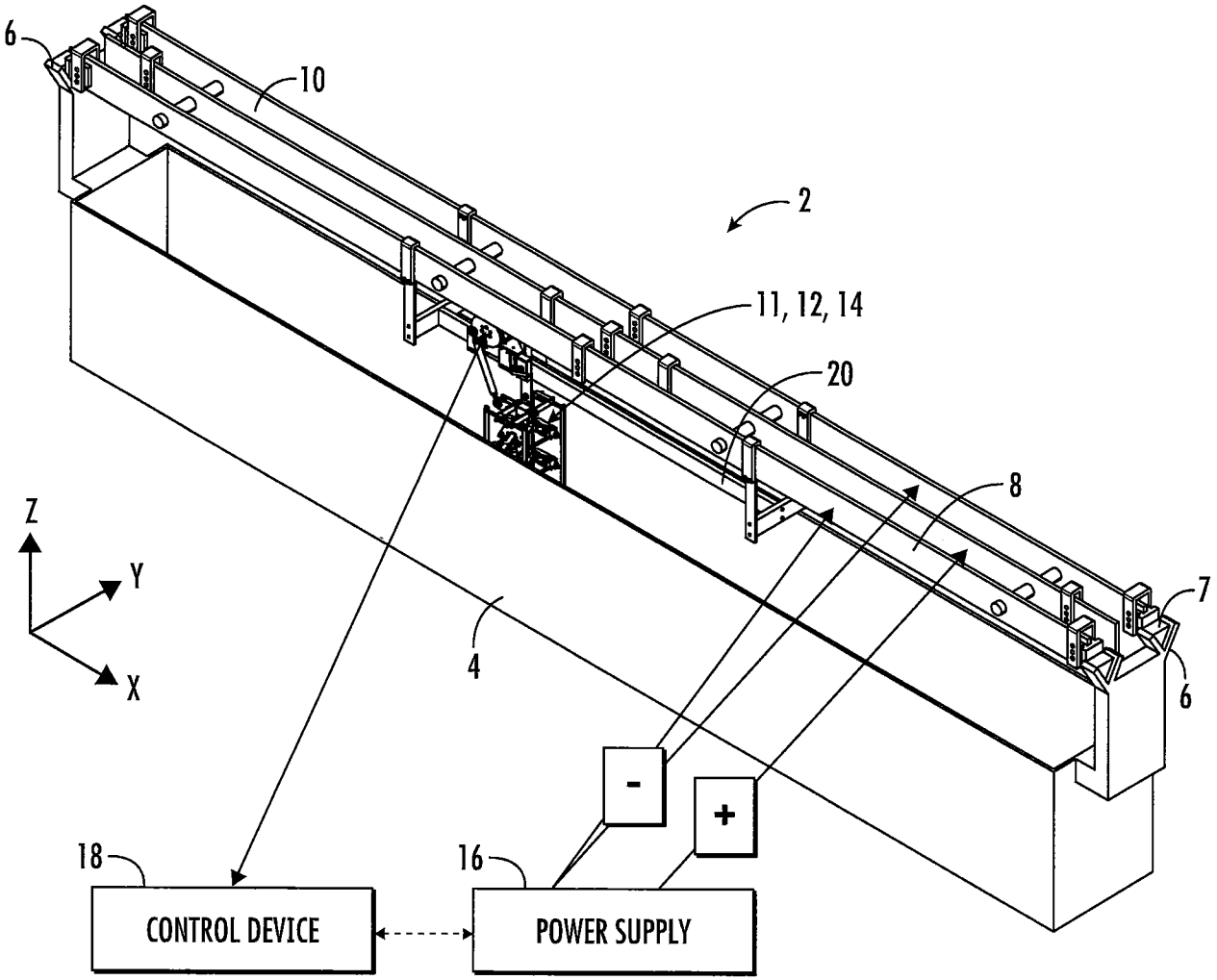
FIG. 1 is a combined isometric and schematic diagram of an embodiment of a single cell of an electroplating system. A single cell includes an electroplating tank with an anode, a cathode, and a power supply for passing current from the anode to cathode.

The present disclosure is in the context of an array of chemical and electrochemical treatment cells. The cells individually have a major axis along a first lateral axis (X) and are arrayed along a second lateral axis (Y). The cells include electrochemical cells that individually include a plating tank, a power supply, a cathode, and an anode. A "flight bar" for supporting the anode and cathode is moved from one tank to another for treating and plating a surface of the cathode (i.e., cathode surface). Within an electrochemical tank, the power supply operates a circuit with metal ions being eroded from the anode and being deposited onto the cathode surface. The first lateral axis (X), the second lateral axis (Y), and a vertical axis (Z) are mutually perpendicular.

In a first aspect of the disclosure, a plating apparatus is configured to simultaneously provide mechanical support, a cathodic connection, and agitation to the cathode. The plating apparatus includes a cathodic support, an electrode assembly, a lower vertical coupler, and an agitation device. The cathodic support includes a cathodic beam and a pair of coupler brackets configured to electrically and mechanically couple the cathodic support to a flight bar assembly. The electrode assembly is configured to support the cathode within the plating tank and includes two pivot connections at an upper end of the electrode assembly. The two pivot connections include a fixed pivot connection and a movable pivot connection that are spaced apart at least along the first lateral axis (X). The lower vertical coupler has an upper end that is affixed to the cathodic beam and a lower end that defines the fixed pivot connection where the lower vertical coupler is attached to the electrode assembly. The agitation device is mounted to the cathodic beam and includes an actuator and a linkage. The linkage is coupled between the actuator and the movable pivot connection. Operation of the actuator causes the linkage to push and pull upon the movable pivot connection to rotate the electrode assembly about the fixed pivot connection with a rotational motion that displaces portions of the cathode along the first lateral axis (X) and the vertical axis (Z). The rotation is about the second lateral axis (Y). This motion is very effective in releasing gas bubbles that can be trapped under features of the cathode. Depending upon the geometry of these features, the magnitude of the rotation may vary. The rotation should typically be at least about 15 degrees in each of two rotational directions (total of 30 degrees) about the lateral axis (Y). Depending upon the geometry of features that tend to trap bubbles, rotation of at least about 20 degrees, 30 degrees, 45 degrees, 60 degrees, 75 degrees, or even 90 degrees in each direction may be desirable. In an illustrative embodiment, the rotation is about 30 degrees in each direction.

In one implementation the cathodic beam has a major axis along the first lateral axis (X). The coupler brackets are coupled to the cathodic beam at opposing ends with respect to first lateral axis (X). The coupler brackets individually include a horizontal beam coupled to the cathodic beam and a pair of upper vertical couplers at opposing ends of the horizontal beam to couple the horizontal beam to the flight bar assembly. The upper vertical couplers individually include receptacles which electrically and mechanically connect cathodic beam to an elongate electrode of a flight bar.

In another implementation, the movable pivot connection is disposed below the fixed pivot connection. The cathode is generally disposed along a second lateral axis (Y) and the vertical axis (Z). The cathode assembly is configured to rotate about the second lateral axis (Y) in response to the operation of the actuator.

In yet another implementation, the actuator includes a motor coupled to a center of a wheel. A driven end of the linkage is rotatively coupled to the wheel. A following end of the linkage is rotatively coupled to the movable pivot connection. Rotation of the wheel causes circular motion of the driven end of the linkage which in turn provides a back and forth motion of the movable pivot connection relative to the fixed pivot connection. In various embodiments, the wheel circular motion has an angular velocity ($\omega$) in a range between 2 and 30 revolutions per minute (RPM).

In a further implementation, the agitation device includes a battery that provides power for the operation of the actuator. The agitation also include a controller configured to receive a wireless signal for controlling operation of the actuator. By providing a combination of battery power and wireless control, the agitation device can be operated independently of existing treatment cells. This allows the agitation device to be implemented as a retrofit to existing chemical and electrochemical treatment cells.

DETAILED DESCRIPTION OF THE PREFERRED EMBODIMENTS

In the following disclosure, various axes are used to describe geometries, orientations, and motion of system components. Mutually perpendicular axes include a first lateral axis (X), a second lateral axis (Y), and a vertical axis (Z). Lateral axes are generally horizontal and the vertical axis is generally aligned with a gravitational reference. By generally, it is implied that a direction or magnitude is by design but can vary within manufacturing or tolerances. Mutually perpendicular rotational axes include theta-X, theta-Y, and theta-Z that quantify rotation about the X, Y, and Z axes respectively. A rotational velocity $\omega$ is a time rate change of a theta. Thus, $\omega_Y$ is a rate of rotation about a the Y-axis of the time rate change of theta-Y.

The context of the following disclosure is a plating system that includes an array of electroplating cells with associated equipment such as plating tanks, power supplies, anodes, and other apparatus for a purpose of electroplating and surface treating articles of manufacture. More particularly, the plating system is used for electroplating metal layers onto aerospace articles. A robotic system is utilized to transfer the articles between cells to allow a sequence of processes including etches and plating to be performed.

Figure 2:
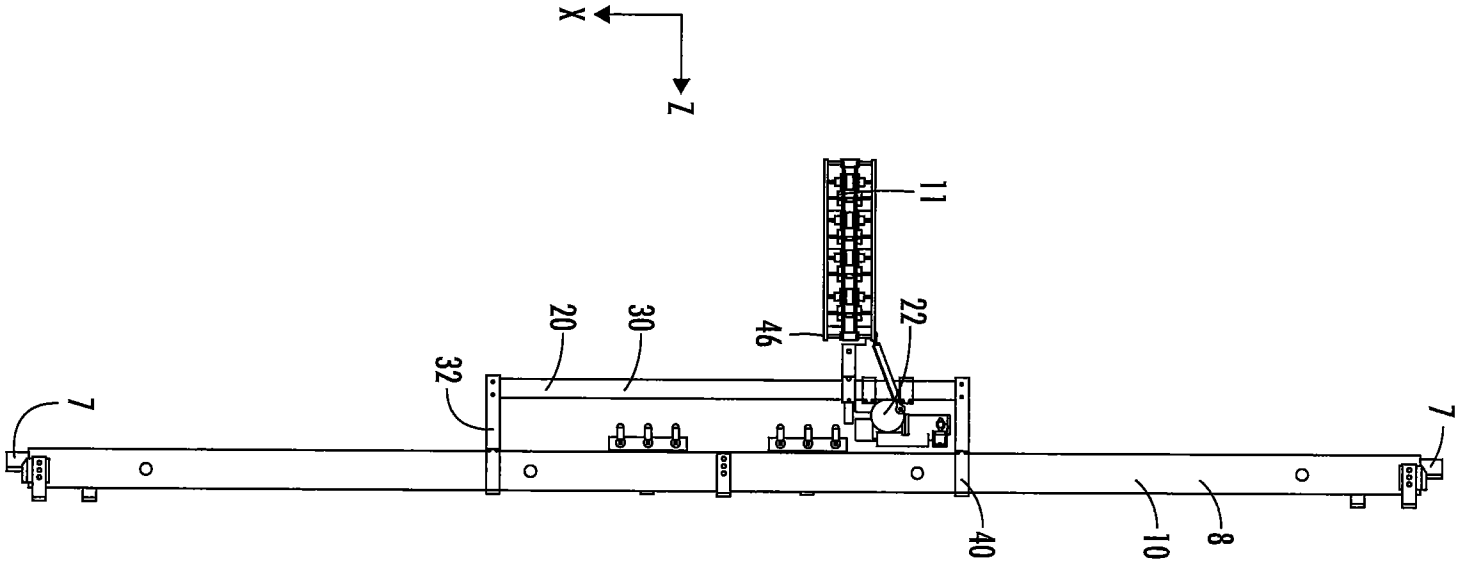
FIG. 2 is a rotated side view of an embodiment of a "flight bar" having an attached adaptive apparatus and a electrode assembly. The view is rotated to provide a more convenient scale.
Figure 3:
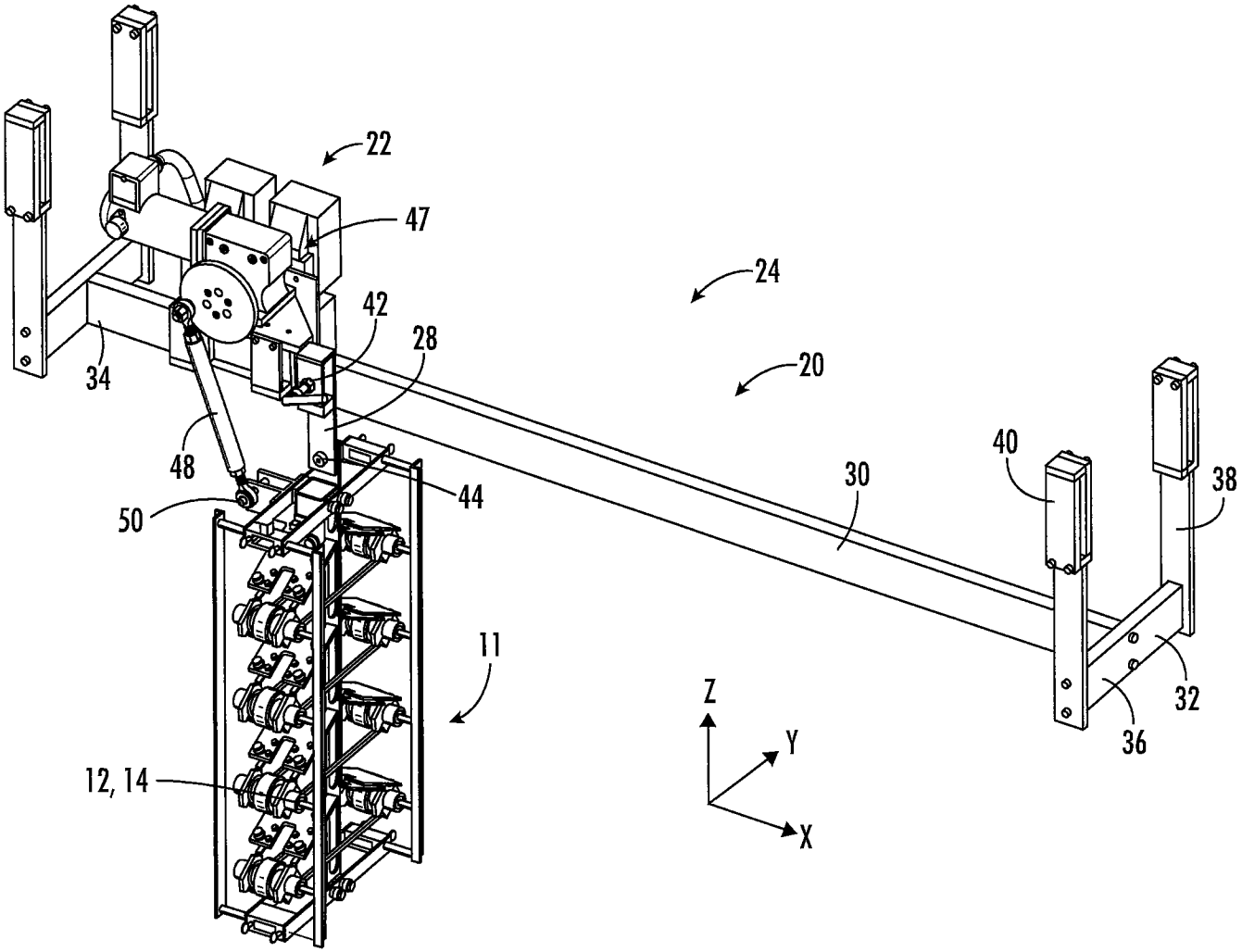
FIG. 3 is an isometric view of an embodiment of an adaptive apparatus coupled to an electrode assembly. The adaptive apparatus can be part of a kit for providing enhanced agitation to an existing electroplating or electroforming system. The kit can also include a wireless control device and/or associated software instructions stored on a non-transient media.
Figure 4:
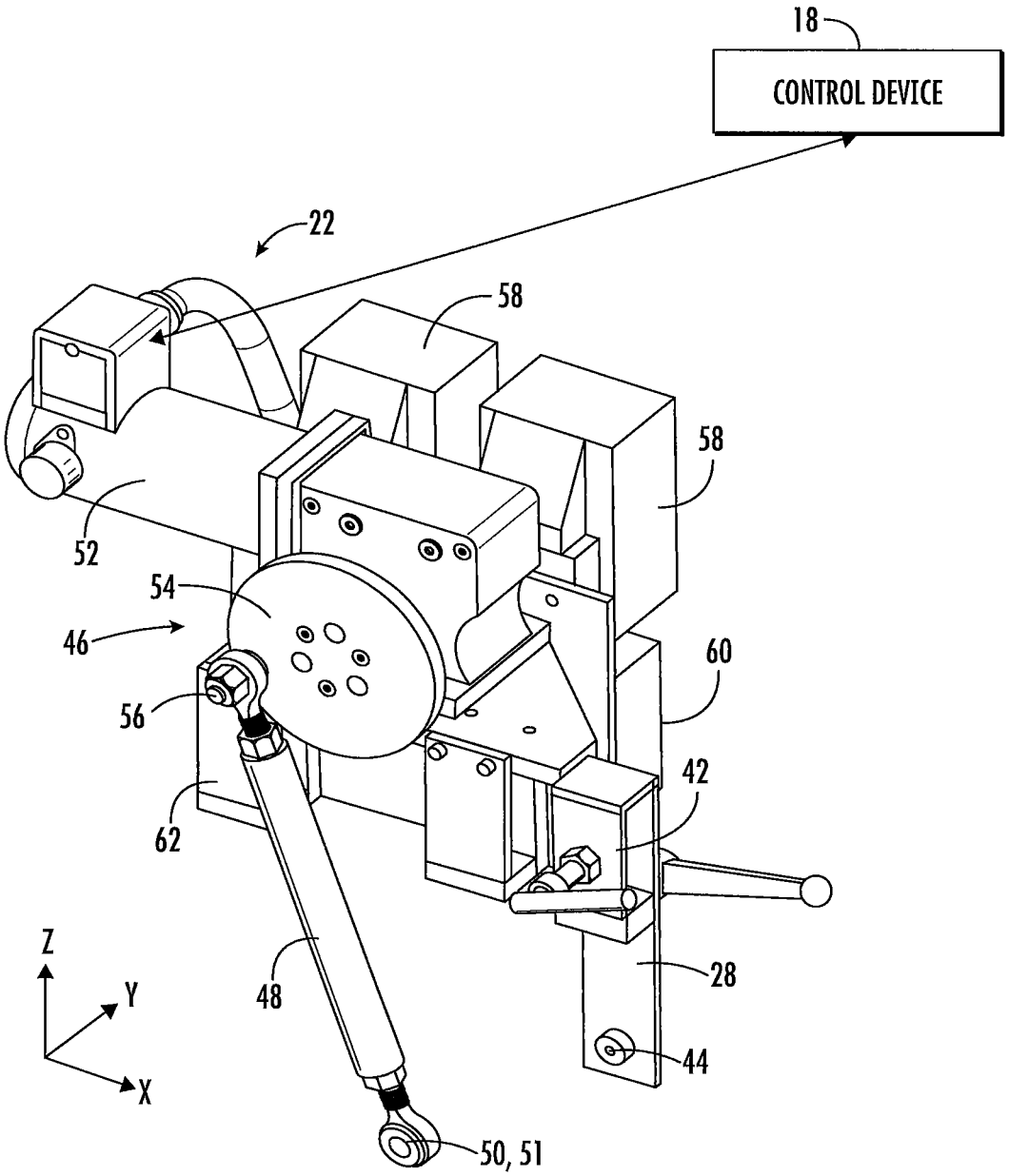
FIG. 4 is an isometric view of a portion of an embodiment of an adaptive apparatus.

The disclosure includes FIGS. 1-4. These views are in order of increasing detail in the following way. FIG. 1 depicts an embodiment of an electroplating cell. FIG. 2 depicts a flight bar and attached components taken from FIG. 1. FIG. 3 depicts the attached components of FIG. 2 without the flight bar. FIG. 4 depicts the agitation device and lower vertical coupler taken from the attached components of FIG. 3.

An embodiment of a single electroplating cell 2 is depicted in FIG. 1. A plating tank 4 contains an electroplating solution (not shown). Coupled to the plating tank 4 are a plurality of V-blocks 6. The V-blocks 6 support conductive ends 7 of a flight bar 8. The flight bar 8 is formed from a plurality of elongate electrodes 10 that are electrically coupled to the conductive ends 7. Within the plating tank 4 is an electrode assembly 11 whose lower end is immersed within the electroplating solution. The electrode assembly 11 supports an anode 12 and a cathode 14. The electrode assembly 11 is supported by the elongate electrodes 10 of the flight bar 8.

In an alternative embodiment, the anode 12 can be separate from the electrode assembly 11. In such an alternative embodiment, the anode 12 is suspended within the plating tank 4 in facing relation with the cathode 14.

A power supply 16 is electrically coupled to the anode 12 and cathode 14 via the elongate electrodes 10 of the flight bar 8. The cathodic (−) side of the power supply 16 is electrically coupled to at least one V-block 6. The V-block 6 is in turn electrically coupled to one of the elongate electrodes 10 of the flight bar 8 through physical engagement of a conductive end 7 with the V-blocks 6. The elongate electrode 10 is in turn electrically coupled to the cathode 14. The anodic (+) connection is made in a like manner. In the illustrative embodiment of FIG. 1, the cathodic side (−) of the power supply 16 is electrically coupled to two outer elongate electrodes 10 as indicated by arrows. The anodic side (+) of the power supply 16 is electrically coupled to an inner elongate electrode 10 that is between the two outer elongate electrodes 10.

Thus, an electrical current loop is provided from the powder supply 16 to the anode 12, through the electroplating solution to the cathode 14, to an elongate electrode 10, to the V-block 6, and back to the power supply 16. In some embodiments, a control device 18 is coupled to the power supply 16 for controlling the power supply 16. The control device 18 can include one or more of a host computer, a laptop computer, a smart phone, a tablet computer or a server computer. The control device 18 can be a single computing device or a plurality of interconnected and/or networked computing devices.

In the illustrated embodiment, the plating tank 4, the flight bar 8, and the elongate electrodes 10 individually have a major axis along the first lateral axis (X). An overall system (not shown) includes a plurality of cells 2 that are arranged along the second lateral axis (Y). A robot (not shown) is configured to transfer the flight bar 8 from one cell 2 to another cell. Transfer occurs by lifting the flight bar 8 in an upward (+Z) direction off of V-blocks of the one cell 2, translating the flight bar along the second lateral axis (Y) to another cell 2, and then lowering the flight bar 8 in a downward (−Z) direction onto V-blocks 6 of the other cell 2. The V-blocks 6 provide both mechanical support and electrical coupling to the power supply 16 for the flight bar 8.

FIG. 2 is a (90 degree) rotated side view of an embodiment of a flight bar 8 coupled to an electrode assembly 11. A cathodic support 20 is electrically and mechanically coupled to elongate electrodes 10 of the flight bar 8. An agitation device 22 is mechanically supported by the cathodic support 20. The cathodic support 20 has a major axis that is aligned with the first lateral axis (X) and the major axis of the elongate electrodes 10 of the flight bar 8.

FIG. 3 is an isometric view of an embodiment of an adaptive agitation apparatus 24 coupled to the electrode assembly 11. The electrode assembly 11 includes one or more cathodes 14 that can be aerospace articles. The electrode assembly 11 can also include the anode 12. The anode 12 and cathode 14 are shown together because they are in close proximity as part of the electrode assembly 11. The adaptive agitation apparatus 24 includes the cathodic support 20, the agitation device 22, and a lower vertical coupler 28.

The cathodic support 20 includes a cathodic beam 30 coupled to a pair of coupler brackets 32 coupled to opposing ends 34 of the cathodic beam 30. The coupler brackets 32 individually couple the ends 34 of the cathodic beam 30 to two of the (cathodic) elongate electrodes 10 of the flight bar 8. The coupler brackets 32 individually have a horizontal beam 36 attached to an opposed end 34 of the cathodic beam 30. The horizontal beams 36 individually extend along the second lateral axis (Y) and are coupled at opposed ends to upper vertical couplers 38. The upper vertical couplers 38 individually include a receptacle 40 for electrically and mechanically coupling the vertical coupler 38 to one of the elongate electrodes 10 of the flight bar 8. (Refer to FIG. 2 for the coupling to the flight bar 8.)

The lower vertical coupler 28 has an upper end 42 that is affixed to the cathodic beam 30 and a lower end that is pivotally attached to an upper end 46 (FIG. 2) of the electrode assembly 11. The lower end of the lower vertical coupler 28 is therefore tantamount to a fixed pivot connection 44 for the electrode assembly 11.

The agitation device 22 includes an actuator 47 coupled to a linkage 48. The linkage 48 is coupled between the actuator 47 and a movable pivot connection 50. Operation of the actuator 47 causes the linkage to push and pull (in a back and forth motion) on the movable pivot connection 50 which rotates the electrode assembly 11 along theta-Y about the fixed pivot connection 44. This rotation provides motion of the cathode 14 along the lateral axis (X) and the vertical axis (Z). This motion along with the rotation improves removal of trapped bubbles that would otherwise cause pitting and defects along the cathode 14. More particularly, this rotation releases gas bubbles or pockets that are trapped under features of the cathode 14.

The magnitude of the rotation of the electrode assembly 11 in theta-Y can vary. In an illustrative embodiment, theta-Y generally equals zero when the electrode assembly is vertical. During the rotational motion, the value of theta-Y varies between plus and minus 30 degrees, for a full range of rotation of 60 degrees. This illustrative range of theta-Y corresponds to a certain range of anode feature geometries. For some systems, theta-Y can vary between plus and minus 15, 20, 30, 45, 60, or 90 degrees, depending upon the anode feature geometries.

FIG. 4 is an isometric view of the control device 18, the agitation device 22, and the lower vertical coupler 28. In the illustrated embodiment, the actuator 47 (FIG. 3) includes a motor 52 coupled to a wheel 54. A driven end 56 of the linkage 48 is coupled to the wheel 54. Rotation of the wheel 54 under power of the motor 52 causes the circular motion of the driven end 56 of the linkage 48 along theta-Y or about the second lateral axis (Y). This has the effect of a following end 51 of linkage 48 pushing and pulling on the movable pivot connection 50. In various embodiments, the motor 52 rotates the wheel 54 with an angular velocity $\omega_Y$ that is within a range between 2 and 30 revolutions per minute (RPM).

The motor 52 is powered by one or more batteries 58. The motor 52 is operated by an agitation controller 60 that is wirelessly coupled to the control device 18. Including batteries 58 and the wireless controller 60 allows the agitation device 22 to be operated independently of the plating cell 2 power supply 16. This allows the agitation device 22 to be used on existing electroplating production systems as an upgrade or enhancement to systems that don't have this advantageous agitation. As such, the agitation device 22 can be part of a kit for adapting an existing plating system with the rotative agitation and trapped bubble removal. The agitation device 22 also includes clamps 62 for affixing the agitation device 22 to the cathodic beam 30.

In some embodiments, a kit (illustrated as elements 18 and 24 in combination) would include the adaptive agitation apparatus 24 and the control device 18 which stores software instructions. The kit would enable an existing electroplating system to be retrofitted with improved agitation. In some embodiments, the kit may include the agitation apparatus 24 and a non-transient media storing software instructions which can be transferred to non-transient media forming a part of the control device 18. When executed by a processor in the control device 18, the software instructions can wirelessly control the adaptive agitation apparatus 24 to provide enhanced agitation and bubble removal.

The specific embodiments and applications thereof described above are for illustrative purposes only and do not preclude modifications and variations encompassed by the scope of the following claims.

What is claimed:

1. A plating apparatus defined along three mutual perpendicular axes including a first lateral axis (X), a second lateral axis (Y), and a vertical axis (Z) and configured to simultaneously provide mechanical support, a cathodic connection, and agitation to a cathode in a plating tank, the plating apparatus comprising:

a cathodic support including a cathodic beam and a pair of coupler brackets configured to electrically and mechanically couple the cathodic support to a flight bar;

an electrode assembly configured to support the cathode within the plating tank and including two pivot connections at an upper end of the electrode assembly further including a fixed pivot connection and a movable pivot connection that are spaced part at least along the first lateral axis (X);

a lower vertical coupler having an upper end that is affixed to the cathodic beam and a lower end that is pivotally coupled to the fixed pivot connection; and an agitation device mounted to the cathodic beam and including an actuator and a linkage, the linkage coupled between the actuator and the movable pivot connection; operation of the actuator causes the linkage to push and pull upon the movable pivot connection to rotate the electrode assembly about the fixed pivot connection with a rotational motion that displaces portions of the cathode along the first lateral axis (X) and the vertical axis (Z).

2. The plating apparatus of claim 1 wherein the cathodic beam has a major axis along the first lateral axis (X), the coupler brackets are coupled to the cathodic beam at opposing ends with respect to first lateral axis (X).

3. The plating apparatus of claim 1 wherein the coupler brackets individually include a horizontal beam coupled to the cathodic beam and a pair of upper vertical couplers at opposing ends of the horizontal beam to couple the horizontal beam to the flight bar.

4. The plating apparatus of claim 1 wherein the movable pivot connection is disposed below the fixed pivot connection.

5. The plating apparatus of claim 1 wherein the cathode is generally disposed at least along a second lateral axis (Y) and the vertical axis (Z), the electrode assembly is configured to rotate about the second lateral axis (Y) in response to the operation of the actuator.

6. The plating apparatus of claim 1 wherein the actuator includes a motor coupled to a wheel, a driven end of the linkage is rotatively coupled to the wheel, rotation of the wheel causes circular motion of the driven end of the linkage.

7. The plating apparatus of claim 6 wherein the wheel rotates about the second lateral axis (Y).

8. The plating apparatus of claim 1 wherein the agitation device includes a battery for providing power for the operation of the actuator.

9. The plating apparatus of claim 1 wherein the agitation device includes a controller configured to receive a wireless signal for controlling operation of the actuator.

10. The plating apparatus of claim 1 wherein the flight bar includes at least one elongate electrode that extends along the first lateral axis (X).

11. The plating apparatus of claim 10 further comprising:

the plating tank;

an anode disposed within the plating tank;

at least one V-block at an end of the plating tank;

a power supply coupled to the V-block and the anode; and the at least one elongate electrode couples to the V-block to complete a plating circuit when an end of the elongate electrode is placed into the V-block.

12. The plating apparatus of claim 1 wherein the electrode assembly is configured to support an anode within the plating tank.

* * * * *